US006702922B2

(12) United States Patent
Wagner et al.

(10) Patent No.: US 6,702,922 B2
(45) Date of Patent: Mar. 9, 2004

(54) PAPERS FOR USE IN DECORATIVE LAMINATES AND METHODS OF MAKING THE SAME

(75) Inventors: Eric Wagner, Canann, CT (US); Dennis Hankey, Sheffield, MA (US)

(73) Assignee: MW Custom Papers, LLC, Stamford, CT (US)

( * ) Notice: Subject to any disclaimer, the term of this patent is extended or adjusted under 35 U.S.C. 154(b) by 0 days.

(21) Appl. No.: 10/196,062

(22) Filed: Jul. 17, 2002

(65) Prior Publication Data

US 2004/0011486 A1 Jan. 22, 2004

(51) Int. Cl.[7] ..... D21H 19/66

(52) U.S. Cl. ..... 162/134; 162/126; 162/127; 162/128; 162/162; 162/181.1; 162/181.2; 162/181.3; 162/181.4; 162/181.5; 162/181.6; 162/183; 162/184; 162/186

(58) Field of Search ..... 162/134, 135, 162/126, 127, 128, 162, 181.1–181.6, 183, 184, 586

(56) References Cited

U.S. PATENT DOCUMENTS

| | | | |
|---|---|---|---|
| 4,054,699 A | 10/1977 | Brinkley | |
| 4,092,199 A | 5/1978 | Ungar et al. | |
| 4,126,727 A | 11/1978 | Kaminski | |
| 4,255,480 A | 3/1981 | Scher et al. | |
| 4,271,221 A | 6/1981 | Hosmer | |
| RE32,152 E | 5/1986 | Scher et al. | |
| 4,605,584 A | 8/1986 | Herr, Jr. et al. | |
| 4,713,138 A | 12/1987 | Ungar et al. | |
| 4,871,503 A | 10/1989 | Ishii et al. | |
| 4,888,220 A | 12/1989 | Mehta | |
| 5,034,084 A | 7/1991 | Schafer et al. | |
| 5,116,418 A | 5/1992 | Kaliski | |
| 5,131,981 A | 7/1992 | Hahn et al. | |
| 5,152,872 A | 10/1992 | Racine et al. | |
| 5,202,180 A | 4/1993 | Watts | |
| 5,266,384 A | 11/1993 | O'Dell et al. | |
| 5,296,340 A | 3/1994 | Tsukada et al. | |
| 5,447,777 A | 9/1995 | Taguma | |
| 5,565,276 A | 10/1996 | Murakami et al. | |
| 5,573,827 A | 11/1996 | Kubota et al. | |
| 5,605,751 A | 2/1997 | Suzuki et al. | |
| 5,820,937 A | 10/1998 | Crabtree et al. | |
| 5,866,209 A | 2/1999 | O'Dell et al. | |
| 5,962,123 A | 10/1999 | Mehta et al. | |
| 5,962,134 A | 10/1999 | Shah et al. | |
| 6,290,815 B1 * | 9/2001 | Magnin et al. | 162/181.1 |

FOREIGN PATENT DOCUMENTS

| | | |
|---|---|---|
| WO | WO 02/12621 | 2/2002 |

* cited by examiner

*Primary Examiner*—Peter Chin
(74) *Attorney, Agent, or Firm*—Thompson Hine LLP

(57) ABSTRACT

A process for forming an abrasion resistant, decorative sheet which comprises forming a web of cellulosic fibers on a papermaking machine and applying a coating suspension including an abrasion-resistant grit and decorative inclusion particles to the upper surface of the web on the papermaking machine.

20 Claims, 1 Drawing Sheet

PAPERS FOR USE IN DECORATIVE LAMINATES AND METHODS OF MAKING THE SAME

BACKGROUND OF THE INVENTION

The present invention relates to wear resistant overlays and décor sheets for use in decorative laminates and floorings and to laminates and flooring prepared therefrom. Decorative laminates have been conventionally made by stacking a plurality of layers of paper impregnated with synthetic thermosetting resins. Normally, the assembly consists of a plurality (for example, three to eight) core sheets made from phenolic resin impregnated Kraft paper, above which lies a decor sheet, usually a print or solid color, impregnated with melamine resin. An overlay sheet, known as a WROL, is often provided on top of the decor sheet which, in the laminate, is made to be as transparent and as wear-resistant as possible thereby allowing the decor sheet to be seen through the overlay while providing protection for the decor sheet from being damaged by scratches and scuffs.

Additionally, it has been found that different desired appearances can be created in the décor sheet by the addition of various decorative particles or additives directly to the paper furnish prior to the deposition of the décor sheet furnish on the paper web. The addition of these types of decorative particles directly to the paper furnish of the décor sheet is generally well known in the industry. However, while the addition of the decorative particles directly to the paper furnish has been found to produce generally acceptable results while producing the desired visual effect for some particles, production of the paper in this manner can be somewhat wasteful because the decorative particles tend to be dispersed throughout the entire paper sheet when in fact only the decorative particles relatively close to the top of the décor sheet surface can actually be seen in the finished laminate.

Furthermore, while it has been found that the use of two separate sheets, namely a WROL sheet and a décor sheet, has produced acceptable wear resistant laminates for most uses, the cost and complexity of the finished laminate is higher than if a single sheet could be found that incorporated both the decorative aspects of the décor sheet and the wear-resistant aspects of the WROL. And, as is discussed in greater detail below, while the industry has recognized the general desirability for producing a single sheet that performs the wear-resistant role of a WROL with the decorative role of a décor sheet, no such sheet has been acceptably produced that accomplishes these goals as disclosed and claimed in the present invention.

In this regard, it is well known that the incorporation of decorative chips into paper sheets for incorporation into wear-resistant laminate materials for use in flooring, countertops and furniture is well known in the art. For example, U.S. Pat. No. 4,126,727 discloses a laminate flooring material having pearlescent chips or flakes incorporated therein over an alternating light and dark background pattern to achieve a desired decorative effect. In that patent, it is disclosed that the chips be blended into a synthetic, thermoplastic resinous polymer wear layer which is extruded or calendered to create a preformed sheet material. This sheet material is then laminated to other sheets to create the finished laminate product.

In another similar invention, U.S. Pat. No. 5,962,123 (assigned to the assignee of the present invention) discloses a laminate flooring material having decorative paper chips incorporated therein. In that patent, it is disclosed that the desired decorative effect may be achieved by adding the paper chips directly to the décor sheet or overlay sheet furnish prior to the distribution of the furnish onto the web. The sheet produced thereby, whether it is an overlay or a décor sheet, is then impregnated with a resin and laminated to additional sheets in order to form the finished laminate as is known in the industry. In yet another related invention, U.S. Pat. No. 5,202,180 discloses casting a plasticized vinyl web containing decorative metallic particles onto a reusable carrier web and then stripping off the vinyl web for incorporation into a suitable laminate.

Additionally, there have been prior art publications which have disclosed the desirability for eliminating the need for separate WROLs and décor sheets and have proposed various methods for accomplishing that goal. For example, U.S. Pat. No. 4,255,480 discloses the addition of a thin layer of mineral particles (such as aluminum oxide) and microcrystalline cellulose directly to the top of a décor sheet thereby obviating the need for a separate WROL.

Additional patents disclose other methods for producing the desired decorative effects in a décor sheet. U.S. Pat. No. 4,271,221 to Hosmer discloses a coating composition that may be applied to a décor sheet at the dry end. The coating composition can contain any desirable pigment, fillers (such as clay, calcium carbonate, talc, titanium dioxide, etc.) and a binder. The coating may be applied at the dry end using any well known coating apparatus including an air knife coater, blade coater, or roll coater. U.S. Pat. No. 5,034,084 to Schafer et al. discloses a décor sheet for use in a decorative laminate. The disclosed décor sheet includes two layers of a thermosetting resin coating wherein the first layer closest to the sheet "contains a flake or scale-shaped pigment in an amount of 2% to 40% by weight" wherein the flake is preferably 5 to 100 microns in size and may be comprised of mica, metals, or metal alloys. The flake is mixed in with the coating resin prior to coating on the substrate that has been impregnated with an aminoplast resin.

However, until the present invention, none of the prior art paper structures have succeeded in fulfilling the need for a single low cost sheet for incorporation into a decorative laminate having the desired decorative and wear-resistant qualities as described above.

SUMMARY OF THE INVENTION

The present invention provides an alternative to prior art paper sheets for use in decorative laminates wherein decorative inclusions were generally added directly to the paper furnish and wherein separate decor sheets and WROLs were required to make the finished laminate. In contrast, the combined décor/WROL sheet of the present invention provides the desired decorative effects and wear-resistant properties in a single sheet that can be made simply and inexpensively on existing papermaking equipment.

The décor/WROL sheet of the present invention may be formed in a multitude of different ways. For example, in accordance with the invention, the decorative inclusion particles may be applied either at the wet end of the paper machine between the primary headbox and the couch roll or on the dry end using a size press or other known dry end coating equipment. The décor/WROL sheet of the present invention includes decorative inclusion particles incorporated therein to give the sheet desired decorative effect. Examples of particles that have been found to provide the desired decorative effect include, but are not limited to: white, colored and interference pearlescent pigments (mica or other flat particles coated with metal oxides such as titanium dioxide or iron oxide); flat particles of thinly layered plastic that give interference colors; coated metal foil or metallized plastic particles in silver and various colors; natural and synthetic fibers in various colors; small paper or plastics chips, etc.

In accordance with the invention, the abrasive grit particles maybe added with the decorative inclusion particles or in other manners conventionally known in the industry. For example, after deposition oft he cellulose fibers on the papermachine wire from a first headbox, the wet web can then be overcoated with the grit particles, such as aluminum oxide, which are deposited from a secondary headbox located relatively closely thereto. In another method, the grit particles may be mixed in with the paper furnish at the primary headbox. In yet another method, the grit particles may be added by means of a curtain coater or a slot coater in a manner consistent with a preferred embodiment of the present invention is disclosed in U.S. Pat. No. 5,820,937, the contents of which are herein incorporated by reference.

Other objects and advantages of the invention will be apparent from the following description, the drawings and the appended claims.

DETAILED DESCRIPTION OF THE INVENTION

Initially, with respect to all of the embodiments of the invention disclosed herein, it is noted that the general term "grit" is used herein to generally describe abrasive particles that may be added to the combined décor/WROL sheet to provide wear-resistant qualities to the finished laminate. These types of particles are generally known in the industry and include silica, alumina, aluminum, conundrum, emery, spinal, as well as other materials such as tungsten carbide, zirconium bride, titanium nitrite, tantalum carbide, beryllium carbide. Silicon carbide, aluminum boride, boron carbide, diamond dust, and mixtures thereof, among others. The suitability of the particular grit will depend on several factors such as availability, cost, particle size distribution and even the color of the particles. Considering cost availability, hardness, particle size availability and lack of color, aluminum oxide is generally the preferred grit for most applications. End use performance dictates the basis weight, ash loading, size and type of grit particles. The grit-preferably has an average particle size of about 10 to 360 microns.

Additionally, it is noted that in some embodiments grit encapsulated in a phenoplast or aminoplast resin may be added to, or even completely replace, the non-encapsulated grit as discussed above. It has been found that the use of such encapsulated grit provides a finished laminate having the desired abrasion resistant properties while helping to prevent unnecessary wear and tear on papermaking process machinery. The production of suitable encapsulated particles that would be operable for incorporation in the present invention is discussed in U.S. Pat. No. 5,962,134, the contents of which are herein incorporated by reference.

Also, it is noted that reference to decorative inclusion particles herein, unless specifically stated otherwise, generally refers to decorative inclusion particles as generally known in used in the industry to create desired visual effects. Examples of particles that may be used for this purpose include, but are not limited to the following: white, colored and interference pearlescent pigments (mica or other flat particles coated with metal oxides such as titanium dioxide or iron oxide); flat particles of thinly layered plastic that give interference colors; coated metal foil or metallized plastic particles in silver and various colors; natural and synthetic fibers in various colors; small paper or plastics chips, etc. The decorative inclusions added may be of any desired size and shape necessary to create the desired visual effect but generally are between 40 microns and 500 microns in size.

Figure 1:
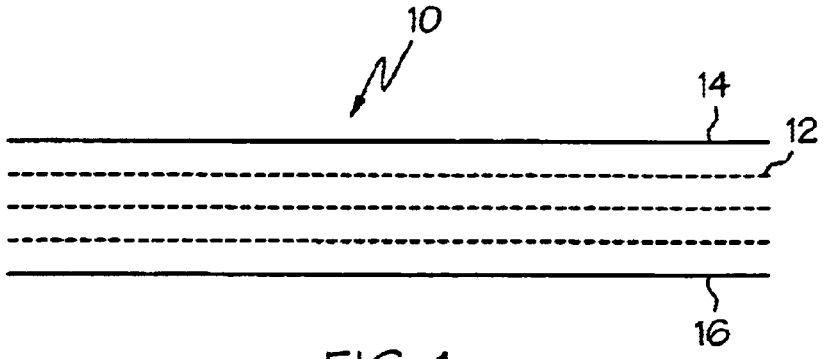
FIG. 1 ( PRIOR ART )
FIG. 1 is a cross-sectional view of a prior art décor sheet incorporating decorative particles.

As will be discussed in greater detail below, prior art décor sheets 10, as shown in FIG. 1, having decorative inclusions 12 of the type used in the present invention to achieve a desired visual effect are well known. The general process for creating these prior art sheets 10 generally involves the addition of the decorative inclusions 12 directly to the paper finish prior to the distribution of the furnish on the papermachine wire. The paper is then dried and finished in the traditional manner resulting in a décor sheet 10 having a top 14, and a bottom 16 with decorative inclusions 12 generally heterogeneously distributed therebetween.

Figure 2:
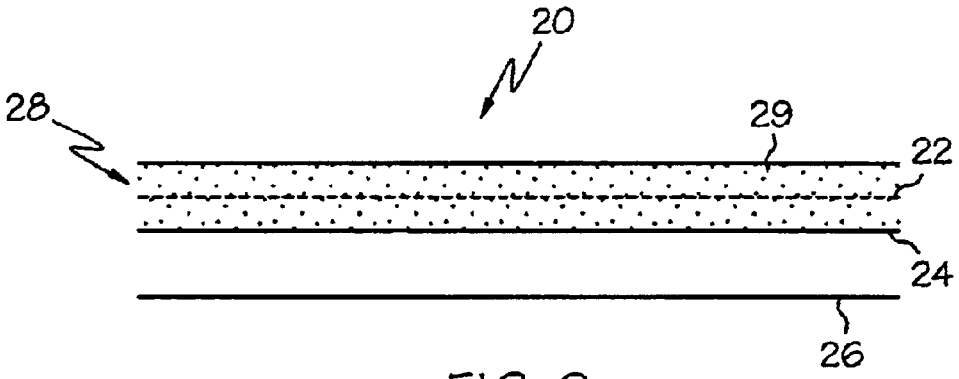
FIG. 2 is a cross-sectional view of décor/WROL sheet made in accordance with the present invention.

In contrast to this prior art practice, a combined décor/WROL sheet 20, as shown best in FIG. 2, is provided in the present invention. The combined décor/WROL 20 differs from the prior art décor sheet discussed above in that the decorative inclusions 22 are not added directly to the paper furnish. Instead, the decorative inclusions 22 are mixed into a coating suspension 28. Additionally, grit particles 29 are also added into the coating suspension (along with thickeners, binders, water, etc. as is known in the industry) thereby providing wear-resistant characteristics to the combined décor/WROL. The coating suspension 28 is then deposited on a pre-prepared base paper layer having a top 24 and a bottom 26. Thus, upon completion of this process, the combined décor/WROL sheet 20 made in accordance with the present invention provides decorative properties due to the distribution of decorative inclusion particles 22 throughout the coating suspension 28 layer of the paper as well as wear-resistant properties due to the distribution of grit particles 29 throughout that same layer.

Figure 3:
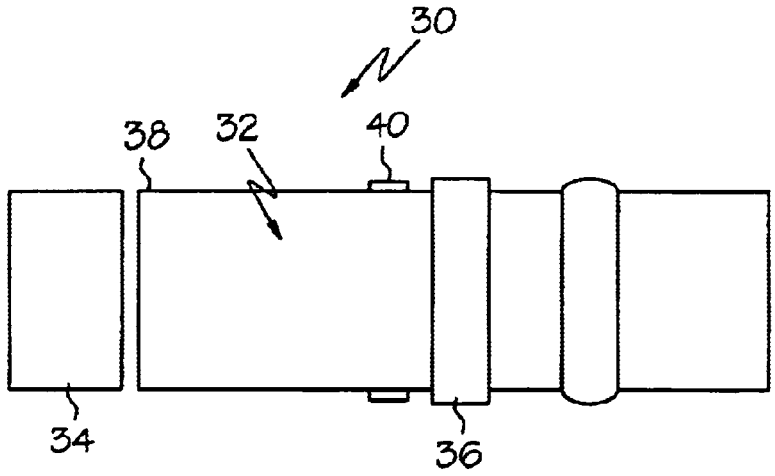
FIG. 3 is a schematic diagram of a papermaking process for use in accordance with the present invention.

As best shown in FIG. 3, a combined décor/WROL sheet 20 in accordance with the present invention may be made on a standard papermachine 30 as currently used in the industry to in the following manner. First, a wet web of base paper 32 having the desired basis weight, color, etc. is deposited on the wire of the papermachine 30 using a primary headbox 34 as is generally well known in the papermaking industry. Next the decorative inclusions 22 are added to a coating apparatus 36, such as a curtain coating device, along with other known materials (water, thickeners, binders, grit, etc.) to create a coating suspension 28. The coating suspension 28 is preferably prepared to a desired viscosity and surface tension in order to get the desired distribution of coating 28 on top of the web 32. The coating suspension 28 is then deposited on the web 32 using the coater 36 at the desired location and the resulting paper is then dried, saturated, and incorporated into a laminate in the conventional manner known in the industry.

More specifically, in one embodiment of the invention disclosed herein, the following method may be used for the creation of an improved combination décor/WROL sheet 20. First, a base paper sheet having a fiber basis weight between 40 to 120 pounds per 3000 square feet is prepared and deposited on the papermachine wire from a primary headbox 34 to form a wet web 32 as is generally known in the industry. Next, a coating suspension 28 is prepared for deposition on the web 32. The coating suspension 28 may contain known thickeners, binders, and water necessary to achieve the desired coating properties and/or effects. The coating suspension 28 also includes grit in the amount around between 3 and 30 pounds per 3000 square feet of paper. Additionally, the coating suspension includes decorative inclusions (such as mica flakes) in the amount between 1 and 20 pounds per 3000 square feet of paper. The coating suspension 28 may have a viscosity of between 1 cP to 10,000 cP. Coating solids, viscosities, and flow rates are controlled by modifying the as is generally known in the to give the desired amount and uniformity of coating.

Then, after preparation, the coating suspension 28 is loaded into the coating device. The coating device may be located on the wet end of the papermachine somewhere between the slice 38 of the headbox 34 and the couch roll 40. In a specific embodiment, a curtain coater may be used as the coating device 36. In this embodiment, the solids are preferably run between about 5 to 40%, the viscosity between about 40 to 2000 cP, and the surface tension between about 30–80 dynes/cm. This process parameter has proved to produce effective results in applying pearlescent pigments. However, other coating applicators can be used such as spray coating, brush coating, dry metering, size press, etc. to produce acceptable results and, as such, are considered within the scope of the invention.

Having described the invention in detail, it will be apparent that modifications and variations are possible without departing from the scope of the invention defined in the appended claims:

What is claimed is:

1. A method for forming a combination décor/WROL sheet comprising the steps of:

mixing cellulosic, fibrous feedstock and water to form a first cellulosic slurry;

depositing said first cellulosic slurry onto a wire of a papermaking machine to form a base paper web;

selecting decorative inclusions for addition to the base paper web to achieve a desired decorative effect;

mixing said decorative inclusions with abrasive grit particles and water to form a décor/grit coating suspension;

depositing said décor/grit coating suspension on said base paper web using a coating device; drying said coated base paper web to form a combination décor/WROL paper.

2. The method of claim 1 wherein said decorative inclusions are selected from the group consisting of mica particles, particles coated with metal oxides, plastic particles, coated metal foil, and metallized plastic particles.

3. The method of claim 1 wherein said decorative inclusions have a median size between approximately 40 microns to 500 microns.

4. The method of claim 1 wherein said grit particles are aluminum oxide particles encapsulated in melamine-formaldehyde resin.

5. The method of claim 1 wherein said coating device is selected from the group consisting of spray coaters, brush coaters, dry metering coaters and size presses.

6. The method of claim 1 wherein said coating suspension has a viscosity between about 40 cP to 2000 cP.

7. The method of claim 1 wherein said base paper dry-basis weight is between about 40 to 120 pounds per 3000 square feet.

8. The method of claim 1 wherein said decorative inclusions are mica chips.

9. The method of claim 1 further including the steps of saturating said combination décor/WROL paper with melamine-formaldehyde resin and incorporating said saturated décor/WROL paper into a decorative laminate wherein said decorative laminate does not include an additional décor paper or an additional WROL paper.

10. A method for forming a combination décor/WROL sheet comprising the steps of:

mixing cellulosic, fibrous feedstock and water to form a first cellulosic slurry;

depositing said first cellulosic slurry onto a wire of a papermaking machine to form a base paper web;

selecting decorative inclusions having a median size between about 40 to 500 microns for addition to the base paper web to achieve a desired decorative effect;

mixing said decorative inclusions with encapsulated or non-encapsulated abrasive grit particles and water to form a décor/grit coating suspension having a viscosity between about 1 cP to 10000 cP;

depositing said décor/grit coating suspension on said base paper web using a coating device;

drying said coated base paper web to form a combination décor/WROL paper.

11. The method of claim 10 wherein said decorative inclusions are selected from the group consisting of mica particles, particles coated with metal oxides, plastic particles, coated metal foil, and metallized plastic particles.

12. The method of claim 10 wherein said decorative inclusions are mica chips.

13. The method of claim 10 wherein said abrasive grit particles are aluminum oxide particles encapsulated in melamine-formaldehyde resin.

14. The method of claim 10 wherein said coating device is selected from the group consisting of spray coaters, brush coaters, dry metering coaters and size presses.

15. The method of claim 10 wherein said coating suspension has a viscosity between about 40 cP to 2000 cP.

16. The method of claim 10 wherein said base paper dry-basis weight is between about 40 to 120 pounds per 3000 square feet.

17. The method of claim 10 wherein said decorative inclusions are coated on said base paper web such that the dried combination décor/WROL paper includes decorative inclusions in the amount between about 1 and 20 pounds per 3000 square feet of paper.

18. The method of claim 10 wherein said coating suspension has a surface tension between about 30 to 80 dynes/cm.

19. The method of claim 10 further including the steps of saturating said combination décor/WROL paper with melamine-formaldehyde resin and incorporating said saturated décor/WROL paper into a decorative laminate wherein said decorative laminate does not include an additional décor paper or an additional WROL paper.

20. A method for forming a combination décor/WROL sheet comprising the steps of:

mixing cellulosic, fibrous feedstock and water to form a first cellulosic slurry;

depositing said first cellulosic slurry onto a wire of a papermaking machine using a primary headbox to form a base paper web having a dry-basis weight between 40 to 120 pounds per 3000 square feet;

selecting mica chips having a median size between about 40 to 500microns for addition to the base paper web to achieve a desired decorative effect;

mixing said mica chips with encapsulated or non-encapsulated aluminum oxide particles having a median size between about 10 to 360 microns and thickeners, binders, and water to form a décor/grit coating suspension having a viscosity between about 40 cP to 2000 cP, a solids content between about 5 to 40%, and a surface tension between about 30 to 80 dynes/cm;

depositing said décoating suspension on said base paper web using a curtain coater positioned between the slice of the primary headbox and a couch roll on the paper-machine such that between 3 and 30 pounds of aluminum oxide particles are deposited per 3000 square feet of base paper and between 1 and 20 pounds of mica chips are deposited per 3000 square feet of base paper;

drying said coated base paper web to form a combination décor/WROL paper.

* * * * *

UNITED STATES PATENT AND TRADEMARK OFFICE

CERTIFICATE OF CORRECTION

PATENT NO. : 6,702,922 B2
DATED : March 9, 2004
INVENTOR(S) : Eric Wagner et al.

It is certified that error appears in the above-identified patent and that said Letters Patent is hereby corrected as shown below:

Column 7,
Line 2, add a blank space between “500” and “microns”.

Column 8,
Line 1, change “décoating” to -- décor/grit coating --.

Signed and Sealed this

Seventh Day of February, 2006

JON W. DUDAS
*Director of the United States Patent and Trademark Office*